United States Patent [19]

Iwase

[11] Patent Number: 4,791,687

[45] Date of Patent: Dec. 20, 1988

[54] MATTRESS WITH SUPPORT

[75] Inventor: Yukio Iwase, Utsunomiya, Japan

[73] Assignee: Prince Sewing Machine Co., Ltd., Tokyo, Japan

[21] Appl. No.: 78,768

[22] Filed: Jul. 28, 1987

[30] Foreign Application Priority Data

Oct. 21, 1986 [JP] Japan ..... 61-161201[U]
Oct. 21, 1986 [JP] Japan ..... 61-161202[U]

[51] Int. Cl.[4] ..... A47C 27/18

[52] U.S. Cl. ..... 5/447; 5/454; 5/464

[58] Field of Search ..... 5/446, 447, 462, 464, 5/454, 485

[56] References Cited

U.S. PATENT DOCUMENTS

| | | | |
|---|---|---|---|
| 3,974,532 | 8/1976 | Ecchuya | 5/468 |
| 4,193,150 | 3/1980 | Vineberg | 5/431 |
| 4,574,412 | 3/1986 | Smith | 5/436 |
| 4,575,884 | 3/1986 | Jamerson et al. | 5/420 |
| 4,601,076 | 7/1986 | Knobeloch | 5/413 |

FOREIGN PATENT DOCUMENTS

| | | | |
|---|---|---|---|
| 0032805 | 7/1981 | European Pat. Off. . | |
| 0046008 | 2/1982 | European Pat. Off. . | |
| 0086336 | 8/1983 | European Pat. Off. . | |
| 481540 | 3/1938 | United Kingdom . | |
| 689258 | 3/1953 | United Kingdom . | |
| 1024312 | 3/1966 | United Kingdom . | |
| 1049458 | 11/1966 | United Kingdom . | |
| 1241486 | 8/1971 | United Kingdom . | |
| 1261475 | 1/1972 | United Kingdom | 5/454 |
| 1263418 | 2/1972 | United Kingdom . | |
| 1268368 | 3/1972 | United Kingdom . | |
| 1302522 | 1/1973 | United Kingdom . | |
| 1518845 | 7/1978 | United Kingdom | 5/464 |
| 1585662 | 3/1981 | United Kingdom . | |
| 2067897 | 8/1981 | United Kingdom . | |
| 1602952 | 11/1981 | United Kingdom . | |
| 2096459 | 10/1982 | United Kingdom . | |
| 2107197 | 4/1983 | United Kingdom . | |
| 2181949 | 5/1987 | United Kingdom . | |
| 2132084 | 7/1987 | United Kingdom . | |

*Primary Examiner*—Alexander Grosz
*Attorney, Agent, or Firm*—Cushman, Darby & Cushman

[57] ABSTRACT

A mattress includes a mattress body and an elongated support. The body includes a fabric case and a pad contained therein, and is formed so as to have predetermined breadth and length. The support has a soft structure and is disposed at a predetermined lengthwise location of the body so as to extend in a direction of the breadth of the body. The inventive mattress is capable of serving as a health aid which is so arranged as to prevent the lower back region of the human body from sinking in a curved manner and also to press against the lumbar vertebra, thereby improving the blood circulation and assuring a comfortable sleep.

6 Claims, 6 Drawing Sheets

MATTRESS WITH SUPPORT

BACKGROUND OF THE INVENTION

1. Field of the Invention

The present invention relates generally to a mattress, and more particularly to a mattress with a support which can be used as a health aid.

2. Prior Art

Various studies have heretofore been pursued with respect to the softness and resiliency of mattresses and there has been a tendency for the cushioning effect of such a mattress to be regarded as important.

On the other hand, recent studies relating to the recumbent form of a human body during sleeping demonstrate that, if one lies down with the body stretched as straight as possible, it is possible to enjoy a comfortable sleep and this may lead to the promotion of health.

However, the aforesaid conventional type of mattress involves a problem in that the lower back region of the body sinks downwardly and a portion of the body is bent, with the result that that portion thus bent is engorgement or hyperemia and this may adversely affect blood circulation.

It is also well known that pressing the lumbar vertebra of a human body is beneficial to health; for example, blood circulation may be improved or the form of the spinal column may be corrected.

SUMMARY OF THE INVENTION

It is therefore an object of the present invention to provide a mattress capable of serving as a health aid which is so arranged as to prevent the lower back region of the body from sinking in a curved manner and also to press against the lumbar vertebra, thereby improving the blood circulation and assuring a comfortable sleep.

According to the present invention, there is provided a mattress comprising a body having a fabric case containing a pad and formed having predetermined lengthwise portion of the body such as to extend in the direction of the breadth of the body.

DESCRIPTION OF THE PREFERRED EMBODIMENTS OF THE INVENTION

Various preferred embodiments of a mattress with a support of the present invention will be hereinafter described with reference to the accompanying drawings.

Figure 1:
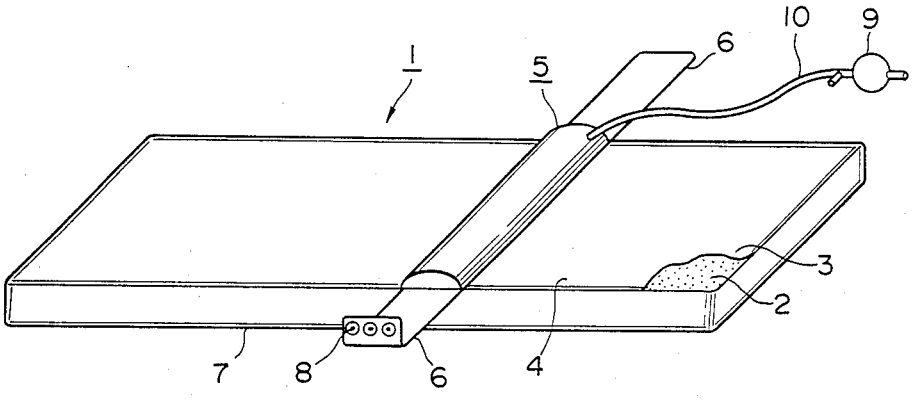
FIG. 1 is a partially broken away, perspective view of a mattress in accordance with a first preferred embodiment of the present invention.
Figure 2:
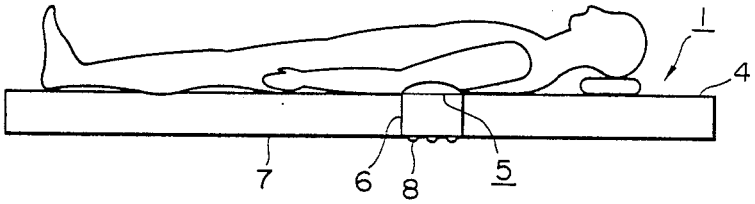
FIG. 2 is a side elevational view of the first preferred embodiment and illustrates an example of the usage thereof.

Referring to FIGS. 1 and 2, a mattress in accordance with a first embodiment of the present invention includes a mattress body indicated generally at 1. The mattress body 1 has a fabric case 3 containing a somewhat hard core 2 made of a flexible synthetic resin composed of open cells, such as polyethylene foam, polyurethane foam or the like.

The mattress body 1 has a surface 4 carrying a support 5 provided with belts 6 at their opposite ends, the belts 6 each having a set of hook buttons 8. The support 5 is arranged to extend in the breadthwise direction of the mattress body 1 at the substantially lengthwise mid portion of the same, and is adapted to be detachable secured to the same by fixing the hook buttons 8 to an underside 7 7 of the mattress body 1.

The aforesaid support 5 is composed of hollow synthetic rubber and has a flat hemispherical cross section as viewed in the direction perpendicular to the length of the mattress body 1. A manually-operated air pump 9 is attached via a tube 10 to the vicinity of one end of the support 5.

The following is a description of a method of using the mattress in accordance with the first embodiment.

First, the hook buttons 8 provided on each of the belts 6 are fixed to the underside of the mattress body 1 to secure the support 5 to the surface 4 of the mattress body 1. Secondly, a sufficient amount of air is charged into the support 5 by means of the air pump 9 until the support 5 becomes hard.

It is preferred that a user lies on the mattress body 1 with the lower back region of the body supported on the support 5. In this state, the support 5 presses against the lower back region thereby improving blood circulation and correcting the form of th lumbar vertebra of the body. In this case, since the core 2 of the mattress body 1 is somewhat hard and the support 5 is charged with a sufficient amount of air, the support 5 efficiently presses against the lumbar vertebra. Also, since the support 5 has an expandable soft structure with a hollow shape and suitable resiliency, it is possible to adjust its hardness by changing the amount of air to be charged. Accordingly, even if the mattress is used for a long period of time, there is no hyperemia in the portion supported by the support 5.

Figure 3:
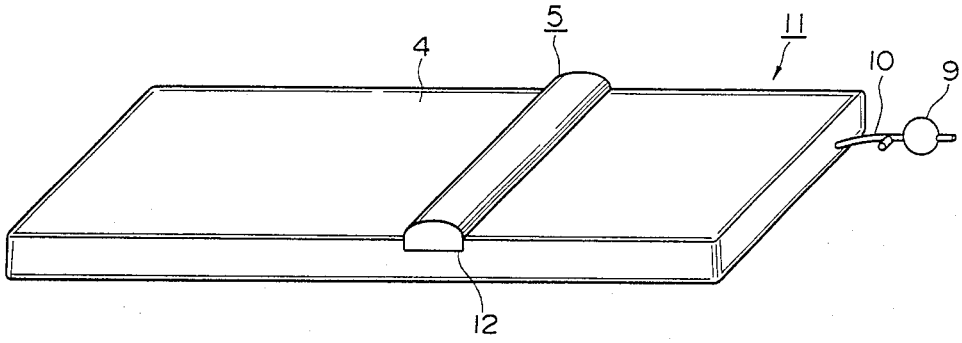
FIG. 3 is a perspective view of a mattress in accordance with a second embodiment of the present invention.
Figure 4:
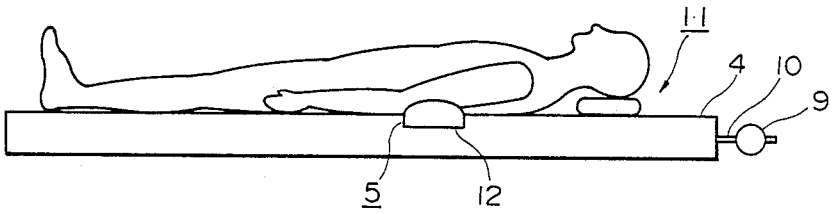
FIG. 4 is a side elevational view of the second embodiment and illustrates an example of the usage thereof.

In addition, since the support 5 is detachably secured to the mattress body 1, the former can be detached from the latter to use the mattress body as a common form of mattress FIGS. 3 and 4 shows a mattress with a support in accordance with a second embodiment of the present invention which differs from the above-described first embodiment in that the support 5 is fitted in a recess 12 formed in the surface 4 of a mattress body 11 at its substantially lengthwise mid portion so as to extend in the breadthwise direction thereof, and that a tube 10 is embedded in the core. In the second embodiment, like reference numerals are used to denote like or corresponding parts relative to those in the above-described first embodiment, and the description is omitted for the sake of simplicity.

A specific feature of the mattress in accordance with the second embodiment resides in that the support 5 is securely fitted into the recess formed in the surface 4 of the mattress body 11 so that, even if a user turns over in his sleep, the support 5 is not shifted. In addition, since the tube 10 is embedded in the core 2, the mattress can be conveniently stored. The other features and advantages are the same as those of the aforesaid first embodiment.

Figure 5:
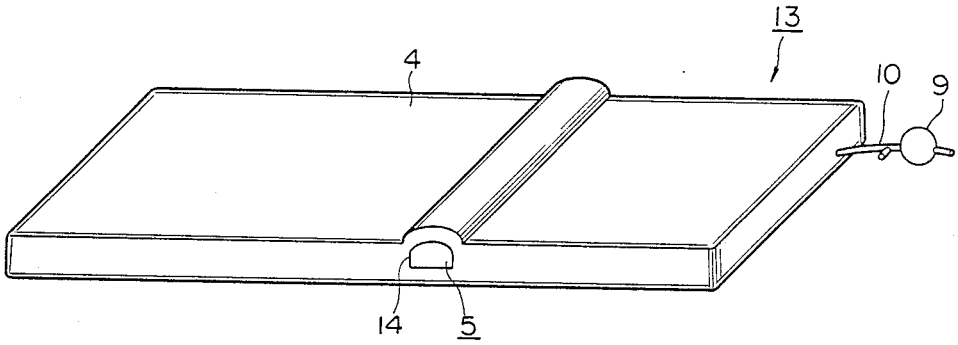
FIG. 5 is a perspective view of a mattress in accordance with a third embodiment of the present invention.
Figure 6:
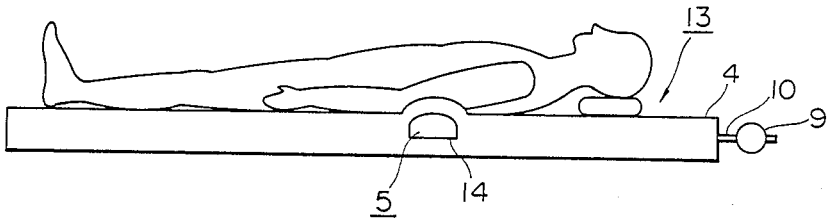
FIG. 6 is a side elevational view of the third embodiment and illustrates an example of the usage thereof.

FIGS. 5 and 6 show a third embodiment of the mattress with a support in accordance with the present invention which differs from the above-described first and second embodiments in that an insertion hole 14 is formed between the longitudinal opposite ends of a mattress body 13 so as to extend in the breadthwise direction of the mattress body, and that the support 5 is inserted in the insertion hole 14. The tube 10 is embedded in the core.

A specific feature of the mattress in accordance with the third embodiment is that the support 5 is arranged to inflate upwardly the portion of the core 2 immediately above the same to form a gentle ridge so that the lower back region is suitably supported by the region occupied by the support 5. The support 5 is provided in the interior of the core 2; accordingly, even if one turns over in his sleep, the support 5 is never dislocated. In addition, since the mattress body 13 can be folded with air evacuated therefrom, it can be conveniently stored in a folded state. The other features and advantages are the same as those of the aforesaid first embodiment.

Figure 7:
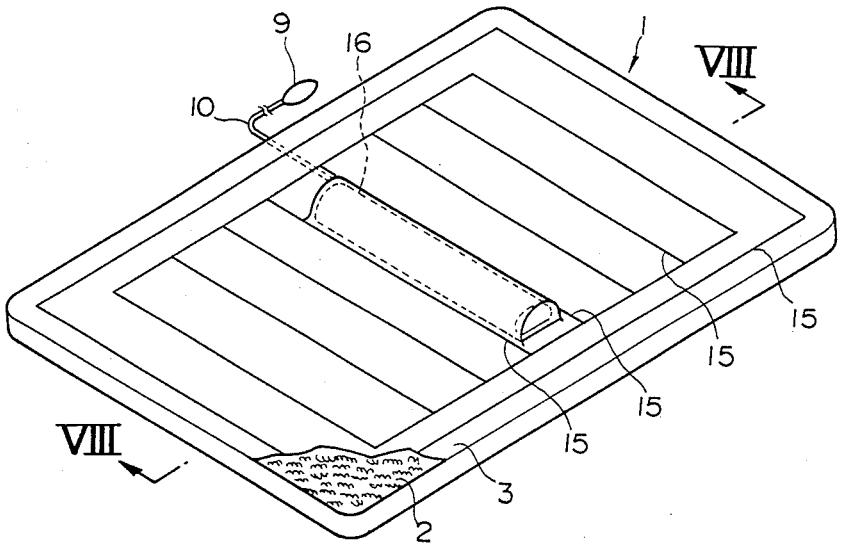
FIG. 7 is a partially broken away, perspective view of a mattress in accordance with a fourth embodiment of the present invention.
Figure 8:
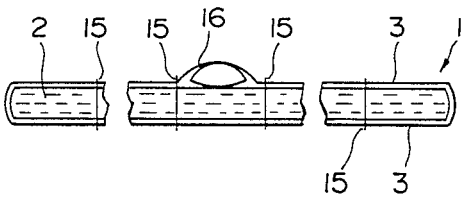
FIG. 8 is a fragmentary sectional view taken along the line VIII—VIII of FIG. 7.

A fourth preferred embodiment of the mattress with a support of the invention will be described with reference to FIGS. 7 and 8. In the fourth embodiment, the mattress body 1 has the fabric case 3 containing the pad 2, the top and the bottom of the fabric case 3 and the pad being stitched together in layers and thus quilted seams 15 are formed as shown.

The pad 2 is a needle-punched "hard pad" made of wool which has a hard cushioning effect. One of the quilted seams 15 is formed along the periphery of the mattress body 1, and a plurality of quilted seams 15 are formed breadthwise at predetermined lengthwise intervals within the area surrounded by the peripheral quilted seam 15.

A support 16 is breadthwise disposed on the top of the pad 2 and in the vicinity of the center line extending between the opposed longitudinal sides of the pad 2, that is, at a location suitable for supporting the lower back region when one lies on his back. In this case, as illustrated, the support 16 is disposed between two adjacent quilted lines 15.

The support 16 is constituted by a hollow bag made of synthetic rubber, and has a rectangular form in top plan and a flat elliptical form in cross section. The support 16 has one end connected via the tube 10 made of synthetic rubber to the manually-operated air pump 9 operable for charging air into the support 16. The aforesaid air pump 9 is disposed in the exterior of the mattress 1 so that, as one lies on the mattress, the one may charge air into the support 16 by the operation of the air pump 9.

A specific feature of the fourth embodiment resides in that the support 16 is disposed at a location which is suitable for supporting the lower back region when one lies on the mattress as in the case of the above-described third embodiment so that, since the support 16 presses against the lower back portion during sleep, it is possible to improve blood circulation and to correct the form of the spinal column. In addition, adjustment of the amount of air to be charged into the support 16 enables desired hardness and height of the same.

Further, since the pad 2 is formed of a hard pad and thus is harder than a commonly used cotton pad, it is possible to prevent the lower back region from sinking downwardly. Accordingly, since one can lie down with the body stretched in a straight manner, it is possible to achieve a suitable recumbent form of the body.

Further, since the support 16 is disposed between the two adjacent quilted seams 15, the support 16 is never dislocated even if one turns over during sleeping.

In addition, if the mattress is used with air evacuated, it can be utilized as a conventional type of mattress. It is to be noted that, although the fourth embodiment employs the support 16 of a hollow bag form, it is also preferable to use a solid support which need not be charged with air. As an example, the support 16 may be made of sponge, somewhat soft rubber or the like; in this case, the air pump 9 is not needed.

Figure 9:
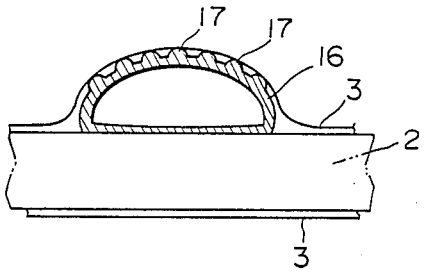
FIG. 9 is a fragmentary sectional view of a mattress in accordance with a fifth embodiment of the present invention, but showing a support having projections formed thereon.

As shown in FIG. 9, a plurality of projections 17 may be formed on the outer surface of the support 16. In this case, since the pressure of the support 16 centers on the ends of the projections 17, it is possible to enjoy an increased finger-pressure effect.

Figure 10:
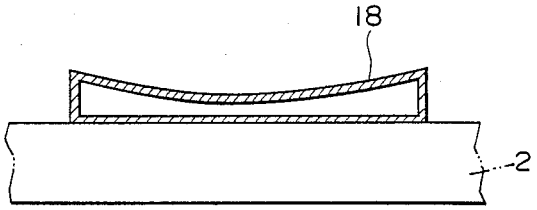
FIG. 10 is a longitudinal sectional view of a mattress in accordance with a sixth embodiment of the present invention, but showing a support having opposite ends which are formed to a height above the center region.

As shown in FIG. 10, a support 18 may be formed such that its upper surface becomes progressively higher from the middle portion toward the opposed ends. In this case, since the support 18 covers the entire lower back region and thus presses against the wide area of the same, a pressing effect can be further increased. In addition, since the body is supported on the opposed ends of the support 18, one can lie down in a further stable state.

Further, if a known electrical heater element is attached to the upper surface of the above-described support, the support serves as a bed warmer. This produces a moxibustion-like effect in addition to pressure derived from air charged into the support or the finger-pressure effect produced by the projections. The blood circulation in muscle is further effectively improved owing to synergistic effects produced by these effects.

Figure 11:
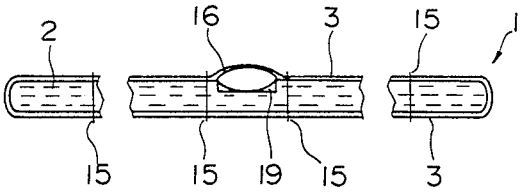
FIG. 11 fragmentary sectional view of a mattress in accordance with a seventh embodiment of the present invention, but showing an elongated recess which receives a support.

As shown in FIG. 11, a recess 19 may be formed in the top of the pad 2 in accordance with the shape of the support 16 so that the former may receive the latter. This arrangement positively prevents the support 16 from being dislocated.

The pad 2 may be made of synthetic material or cotton instead of wool. In addition, if the mattress having the aforesaid arrangement is laid over a mattress of the type which is commonly used, a further improved cushioning effect can be enjoyed and this may assure a further comfortable sleep.

It is to be noted that, although, in the respective embodiments, the support is disposed at a location suitable for supporting the lower back region for the purpose of illustration, the support may be disposed at a given location corresponding to the back region, the shoulder, ankles or any other portion of the body. For example, if the support is disposed at a location corresponding to the head, it serves as a pillow. The present invention is applicable to mattresses having a body which can be folded into three in the longitudinal direction thereof. Although the present invention is applied to a typical mattress filled with cotton material of the type which is used, for example, in Japan. In this case, it is preferable to use "hard cotton" padding. The support may also be made of synthetic resin, natural rubber or the like.

Figure 12:
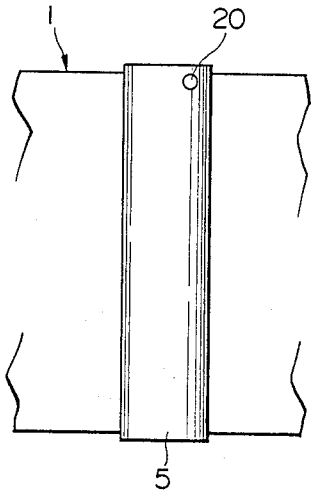
FIG. 12 is a fragmentary plan view of a mattress in accordance with an eighth embodiment of the present invention.
Figure 13:
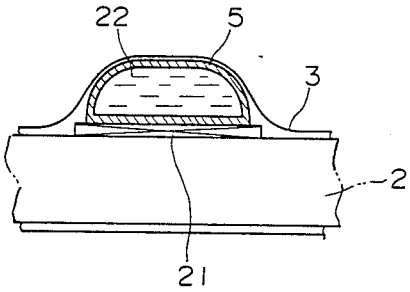
FIG. 13 is a fragmentary sectional view of a mattress in accordance with a ninth embodiment of the present invention.

FIG. 12 shows a further modified mattress in accordance with the present invention in which the support 5 includes an inlet for supplying water in the interior of the support 5 and a cap 20 threaded thereon. In this embodiment, warm or cool water is supplied from the inlet 20 into the interior or the support 5. In addition, FIG. 13 shows a further modified mattress which differs from the mattress of FIG. 12 in that electric heater 21 is disposed between the support 5 and the pad 2 for heating water 22 in the support 5. In this embodiment, water is supplied into the support 5 and then heated to a moderate temperature.

As described above, the present invention provides the mattress with the support having the fabric case containing the pad, the support having a soft structure being attached to the upper surface of the pad such that the support is breadthwise disposed in the vicinity of the generally central line extending between the opposed longitudinal sides. When one lies down on such a mattress, the support presses against the lower back region of the body so that it is possible to enjoy effect similar to finger pressure or the like. This effects improve the blood circulation in the pressed portion and are thus beneficial to health, thereby assuring a comfortable sleep.

What is claimed is:

1. A mattress comprising:

a mattress body including a fabric case and a pad contained therein, said body being formed so as to have predetermined breadth and length; and an elongated support having a hollow soft structure and disposed at a generally lengthwise mid portion of said body so as to extend in a direction of the breadth of said body, said support including fluid supplying means attached thereto for supplying fluid to an interior of said support, said support being interposed between said pad and that portion of said fabric case constituting the top of said body;

said fabric case and said pad being quilted to surround said support to thereby prevent said support from being shifted.

2. A mattress according to claim 1, in which said support has a plurality of projections in its upper surface.

3. A mattress according to claim 1, in which said pad of said body has a recess formed in an upper surface thereof for receiving the lower portion of said support.

4. A mattress according to claim 1, in which said support is formed so as to become progressively thicker from its substantially lengthwise mid portion to its opposite ends.

5. A mattress according to claim 1, in which said supplying means is defined by a water inlet for supplying water to the interior of said support, said support including heating means attached thereto for heating said water supplied in the interior of said support.

6. A mattress according to claim 1, in which said fluid supplying means comprises a tube having one end connected to said support so that said tube communicates with the interior of said support and an air pump connected to the other end of said tube.

* * * * *